US005237137A

United States Patent [19]

Lorenz et al.

[11] Patent Number: 5,237,137

[45] Date of Patent: Aug. 17, 1993

[54] ISOLATING SWITCH FOR METAL-CLAD, COMPRESSED-GAS INSULATED HIGH-VOLTAGE SWITCHGEAR

[75] Inventors: Dieter Lorenz; Ingo Seubert, both of Berlin, Fed. Rep. of Germany

[73] Assignee: Siemens Aktiengesellschaft, München, Fed. Rep. of Germany

[21] Appl. No.: 857,936

[22] PCT Filed: Sep. 19, 1990

[86] PCT No.: PCT/DE90/00722

§ 371 Date: May 18, 1992

§ 102(e) Date: May 18, 1992

[87] PCT Pub. No.: WO91/07768

PCT Pub. Date: May 30, 1991

[30] Foreign Application Priority Data

Nov. 17, 1989 [DE] Fed. Rep. of Germany ..... 3938711

[51] Int. Cl.[5] ..... H01H 33/12; H01H 33/42

[52] U.S. Cl. ..... 200/146 R; 200/148 B; 200/148 F

[58] Field of Search ..... 200/146 R, 146 A, 148 R, 200/148 B, 148 F

[56] References Cited

U.S. PATENT DOCUMENTS 4,445,014 4/1984 Gruner et al. ..... 200/146 R
4,559,424 12/1985 Lorenz et al. ..... 200/146 R

FOREIGN PATENT DOCUMENTS 0066533 12/1982 European Pat. Off. .
0138743 4/1985 European Pat. Off. .
2547107 12/1984 France .

*Primary Examiner*—J. R. Scott
*Attorney, Agent, or Firm*—Kenyon & Kenyon

[57] ABSTRACT

In an isolating switch for metal-clad, compressed-gas insulated high-voltage switchgear, a mechanical control unit containing a rotatably supported lever arrangement. The lever arrangement locks automatically in a neutral position and retains an auxiliary contact pin until it is released by a guide surface connected to the main contact pin. A mating contact of the auxiliary contact pin is also spring-loaded and follows this auxiliary contact pin somewhat after being released, initially while maintaining the equipotential bonding.

27 Claims, 6 Drawing Sheets

ISOLATING SWITCH FOR METAL-CLAD, COMPRESSED-GAS INSULATED HIGH-VOLTAGE SWITCHGEAR

BACKGROUND OF THE PRESENT INVENTION

The present invention relates to an isolating switch for metal-clad, compressed-gas insulated high-voltage switchgears having an isolating distance between electrodes and able to be short-circuited by a tubular, movable main contact pin, whose fixed mating contact has a hollow design. The movable main contact pin may contain an auxiliary contact pin, which is capable of moving axially in the main contact pin and which with its end facing the isolating distance, penetrates a clamping ring inside the main contact pin and is surrounded by a spring, which extends between the clamping ring and a limit stop on the auxiliary contact pin. In the neutral position, the auxiliary contact pin is situated inside the movable main contact pin and, in the closed position of the isolating switch, abuts on a spring-loaded mating contact situated in the hollow mating contact of the main contact pin. At the beginning of the opening movement of the movable main contact pin, it remains in this manner until it is returned to the neutral position with a velocity that is greater than the movement of the movable main contact pin by the spring after being released by a mechanical control unit permanently mounted inside one of the field plates.

This type of isolating switch is disclosed by EP O 066 533 B1. In the known isolating switch, both the auxiliary contact pin as well as its mating contact are each surrounded by a spring. This spring biases the auxiliary contact pin and the mating contact in the opening direction. To secure the contact in the closed position, a latching mechanism connects the auxiliary contact pin and its mating contact in an interlocking manner, which is why one of the two parts must execute an angular movement. When the isolating switch is switched off, the triggering of this angular movement and thus the release of the auxiliary contact pin is effected by a mechanical control unit at a predetermined instant based on the position of the main contact pin, namely when the main contact pin has reached the dielectric distance to the field plate of the mating contact necessary to guarantee a dielectric strength. After that, the auxiliary contact pin is retracted by its spring with a velocity greater than that of the main contact pin. Therefore, with the known isolating switch, electric arcs of low amperages can also be extinguished without damage occurring, for example, when off-load transformers are switched off.

The triggering of the opening movement of the auxiliary contact pin can, in fact, be set exactly in the known isolating switch, but the latching action of these known devices is not free of friction. Therefore, materials of the parts coming into contact with one another during the latching action require certain properties. Nevertheless, one cannot, with certainty, prevent wear of the parts and, therefore the triggering instant is adversely affected.

Therefore, the present invention overcomes these problems of known switches by simplifying the construction of an isolating switch of this type and designing the triggering of the auxiliary contact pin so that it is largely free of friction and not subject to wear.

SUMMARY OF THE INVENTION

To achieve this solution, in an isolating switch of the type mentioned above in the present invention, the mechanical control unit contains a rotatably supported lever arrangement. This lever arrangement locks automatically in the neutral position in the field plate allocated to the main contact pin. This lever arrangement does not prevent the closing movement of the auxiliary contact pin and retains the auxiliary contact pin at the beginning of the opening movement of the main contact pin until it is deflected by a guide surface connected to the main contact pin. The contacting or the equipotential bonding between the mating contact and the auxiliary contact pin is achieved thereby in the closed position simply by an abutment between the two opposite spring-loaded parts (i.e., the auxiliary contact pin and the corresponding mating contact). If, as a result of the mechanical control unit, the blocking of the auxiliary contact pin is released in the closed position, then no frictional resistance whatsover prevents the auxiliary contact pin from springing back at high velocity. Consequently, the once adjusted triggering instant is retained, unchanged, independent of the operational life of the isolating switch or of the number of opening operations already carried out.

In a further advantageous embodiment of the present invention, the mating contact of the auxiliary contact pin has a spring-loaded shield electrode, which, when in the neutral position, is situated in an opening of a shielding field plate associated with that electrode. The main contact pin also comes to abut against this shield electrode in the closed position, and presses it inside its associated shielding field plate. It is also advantageous when, during the opening movement the spring acting on the shield electrode produces a greater acceleration, until the neutral position of the shield electrode is reached, than the acceleration of the auxiliary contact pin.

Thus, when the isolating switch is switched on, the shield electrode, which constitutes the mating contact of the auxiliary contact pin, is pressed by the main contact pin out of its neutral position and, consequently, the spring surrounding the mating contact of the auxiliary contact pin is prestressed. The prestressing of the spring and of the mating contact is initially maintained during the opening movement of the main contact pin by the automatic locking of the lever arrangement of the mechanical control unit, which causes the auxiliary contact pin to be blocked in the closing position, i.e., when abutting on the pushed-back shield electrode. Only when the lever arrangement is disengaged by the guide surface connected to the main contact pin and thus when the auxiliary contact pin is released, does the spring tension of the spring surrounding the mating contact become effective in the sense that, until it reaches its neutral position, the shield electrode follows the auxiliary contact pin, without the equipotential bonding being interrupted. Thus, the auxiliary contact pin accelerates before the contacting is cleared and, therefore, when it separates from the shield electrode, it already has a high velocity, which is then increased even further.

Constructing the automatic locking of the lever arrangement by having a restoring spring press the lever arrangement in the neutral position against a limit stop is expedient. This limit stop can have a fixed or alternately a movable configuration. In a movable configuration, the lever arrangement contains two levers arranged symmetrically to the longitudinal axis of the main contact pin, connected by the restoring spring, and pressed against a centrical lug of the auxiliary contact pin. In this manner, a simple centering of the auxiliary contact pin is also achieved.

Furthermore, to reduce the friction within the mechanical control unit, providing each of the lever ends of the lever arrangement abutting on a limit stop or a guide surface with a roller is recommended. For the same reason, designing the guide surface of the mechanical control unit connected to the main contact pin as a cam, which shows an area that runs parallel to the longitudinal axis of the movable main contact pin and thereby enables the triggering instant to also be set more exactly is also advantageous.

BRIEF DESCRIPTION OF THE DRAWINGS

The present invention is explained in still greater detail in the following based on the exemplified embodiments, schematically depicted in FIGS. 1 through 13 of the drawings. The scope of the present invention is not limited to these exemplified embodiments, however.

FIGS. 2–7 depict the closing movement of the isolating switch according to the present invention.

FIGS. 8–12 depict the opening movement of the isolating switch according to the present invention.

In all the FIGS., the same reference numbers are applied for the same parts.

DETAILED DESCRIPTION

Figure 1:
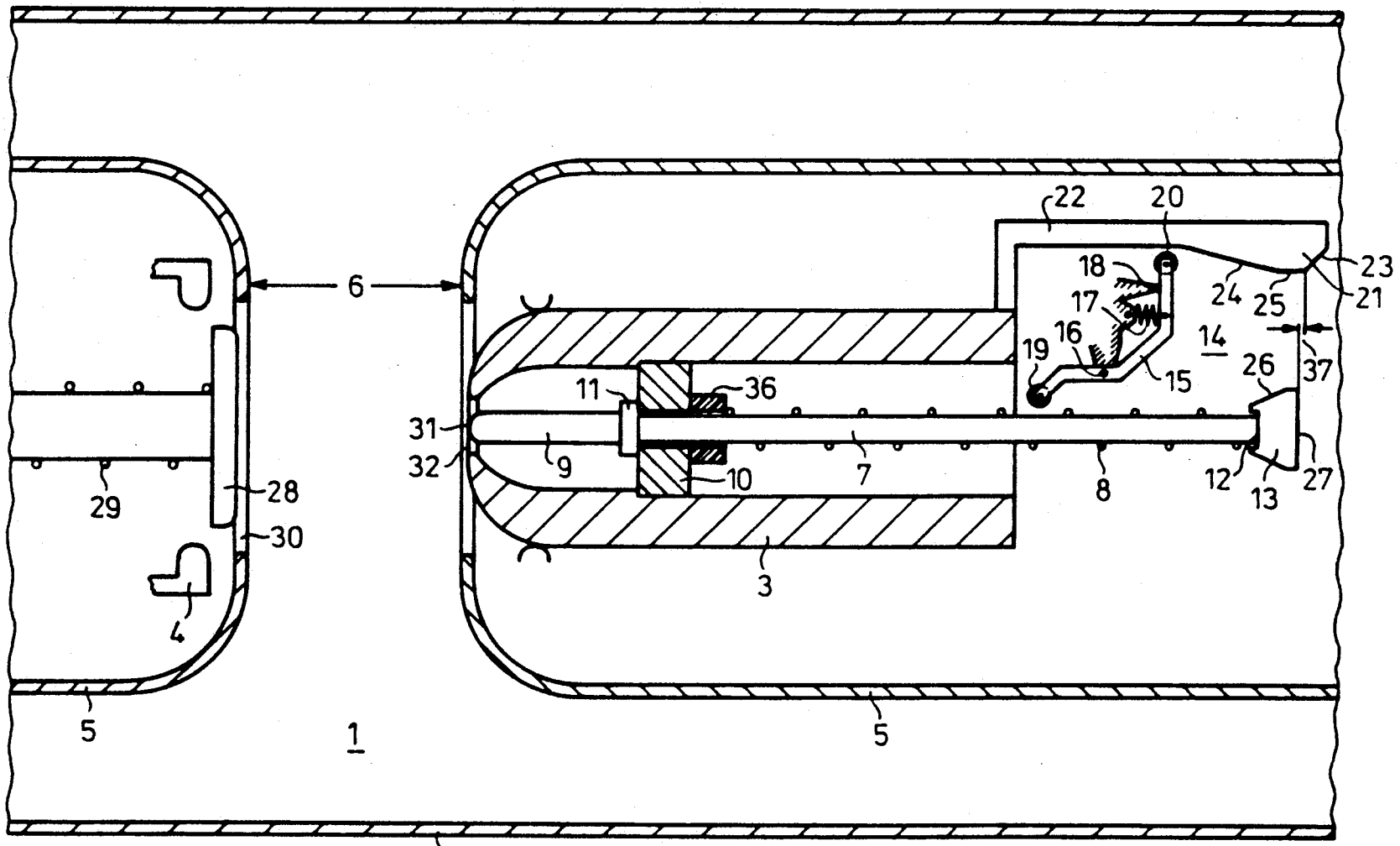
FIGS. 1 to 12 refer to the first exemplified embodiment and each depict a longitudinal section through the isolating switch, whereby FIGS. 1 and 2 correspond to one another, but FIG. 1 is of a larger scale than the other FIGS.

The isolating switch 1 of a metal-clad high-voltage switchgear, insulated with compressed gas, in particular $SF_6$, is situated in a tubular, metallic grounded casing 2. To equalize the electric field between the metallic casing 2 and the tubular, movable main contact pin 3 and the likewise tubular, fixed mating contact 4 (only a portion of which is shown), both the moveable contact pin 3, as well as the mating contact 4 are surrounded by shielding field plates 5.

The isolating distance 6 indicated by arrows lies between the front ends of the two shielding field plates 5. The isolating distance is bridged in the closed position of the isolating switch 1 by the movable main contact pin 3. For the sake of better clarity, the actuation of the main contact pin 3 is not depicted. However, as is customary for isolating switches, the actuation of the main contact pin 3 is relatively slow. Therefore, a centrally arranged auxiliary contact pin 7 is provided inside the tubular, movable main contact pin 3. The auxiliary movable contact pin 7 remains in the neutral position inside the main contact pin 3 during the closing movement and is propelled by a special compression spring 8 with a greater velocity than that of the main contact pin 3 during the opening movement.

The compression spring 8 surrounds the auxiliary contact pin 7. To permit a simple loading of the spring, the auxiliary contact pin 7, with its front end 9 facing the isolating distance 6, penetrates a clamping ring 10 situated inside the main contact pin 3, against which it abuts, with the help of a front limit stop 11, in the neutral position in which it is situated inside the main contact pin. At the rear end 12 of the auxiliary contact pin 7, a conical adjusting screw 13 is provided. One can adjust the preloading of the spring 8 by varying the position of the adjusting screw 13 on the auxiliary contact pin 7.

Moreover, a mechanical control unit 14 for triggering the opening movement of the auxiliary contact pin 7 is arranged inside the shielding field plate 5 surrounding the main contact pin 3. The lever arrangement of this mechanical control unit 14 comprises a two-armed angle lever 15, fixably supported at the pivot point 16. This angle lever 15 is pressed in its neutral position by the restoring spring 17 against the stationary limit stop 18. The ends of the two-armed angle lever 15 are deflected during the switching motion of the isolating switch and are, therefore, provided with rollers, namely with the blocking roller 19, which faces the auxiliary contact pin 7, and with the contact roller 20 at the other end of the angle lever 15.

The guide surface 21 for the contact roller 20 is connected via a link 22 to the main contact pin 3 and has two tapered stop faces 23, 24, which run into one another. Extending between these stop faces is an area 25, which runs parallel to the longitudinal axis of the main contact pin 3. The inclination of the stop face 24 is flatter than the radius of curvature of the lever arm of the angle lever 15 facing this stop face. On the other hand, the blocking roller 19 is deflected by the conical surface 26 of the adjusting screw 13, and the end face 27 of the adjusting screw 13 effects the self-locking or blocking of the angle lever 15 against the limit stop 18.

The mating contact for the auxiliary contact pin 7 is designed as a shield electrode 28 and, is spring-loaded by a compression spring 29. In the neutral position of the compression spring 29, the shield electrode 28 is situated in the front-side opening 30 of the shielding field plate 5 of the mating contact 4. The surface of the shield electrode 28 is selected to be large enough so that not only the end face 31 of the auxiliary contact pin 7 comes to abut against it, but also the end face 32 of the main contact pin 3.

Figure 2:
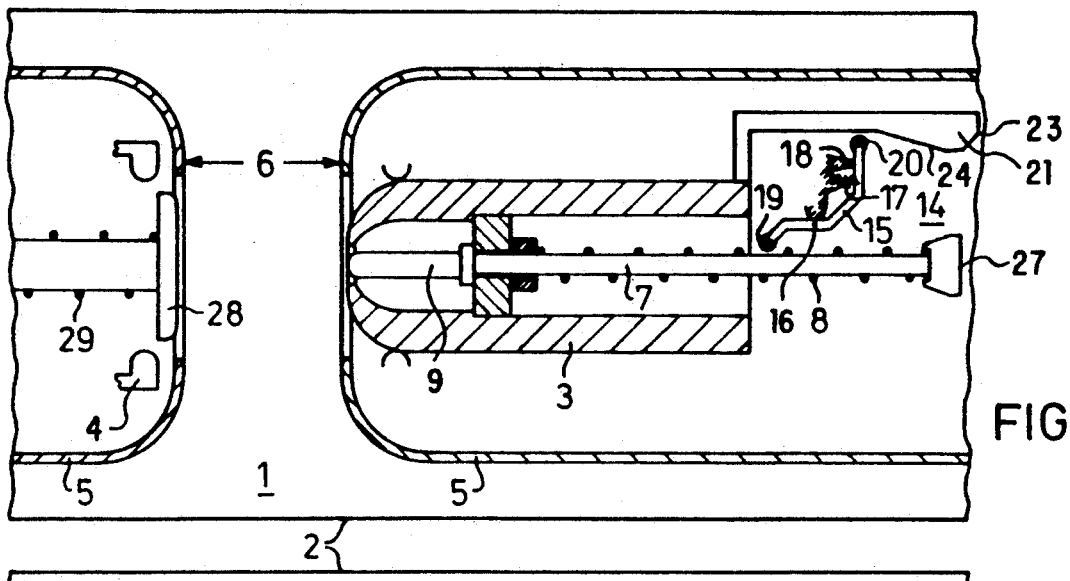
Figure 3:
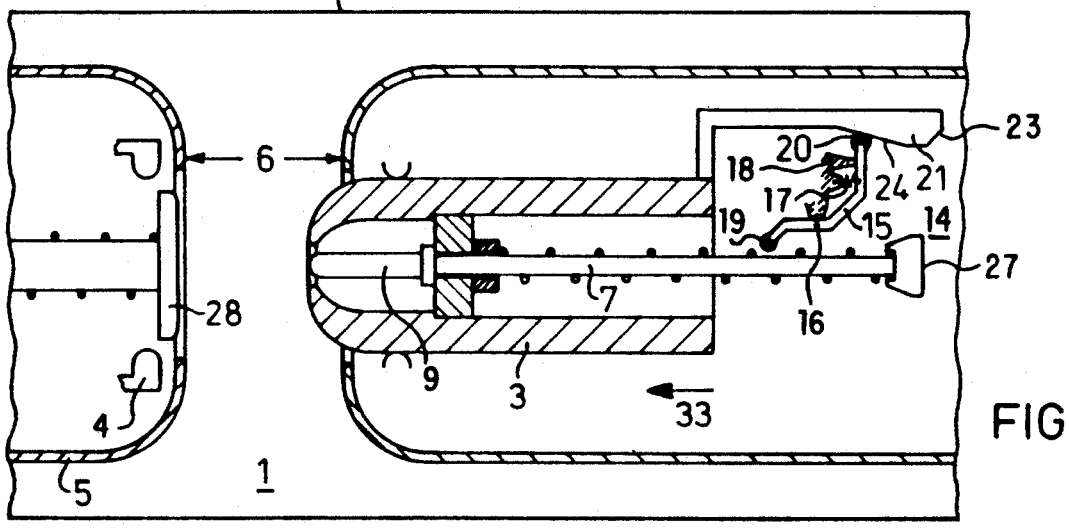

The function of the isolating switch 1 designed according to the present invention is depicted as follows:

Like FIG. 1, FIG. 2 shows the open position of the isolating switch, in which the auxiliary contact pin 7 is situated inside the movable main contact pin 3. The two-armed angle lever 15 of the mechanical control unit 14 is likewise in the neutral position and will, therefore, be pressed by the restoring spring 17 against the limit stop 18. The blocking roller 19 and the contact roller 20 do not have any contact with other surfaces. FIG. 3 shows the beginning of the closing movement of the movable main contact pin 3, as indicated by the arrow 33. This main contact pin 3 has already moved so far into the isolating distance 6 that the stop face 24 of the guide surface 21 facing the main contact pin 3 abuts against the contact roller 20 of the angle lever 15.

Figure 4:
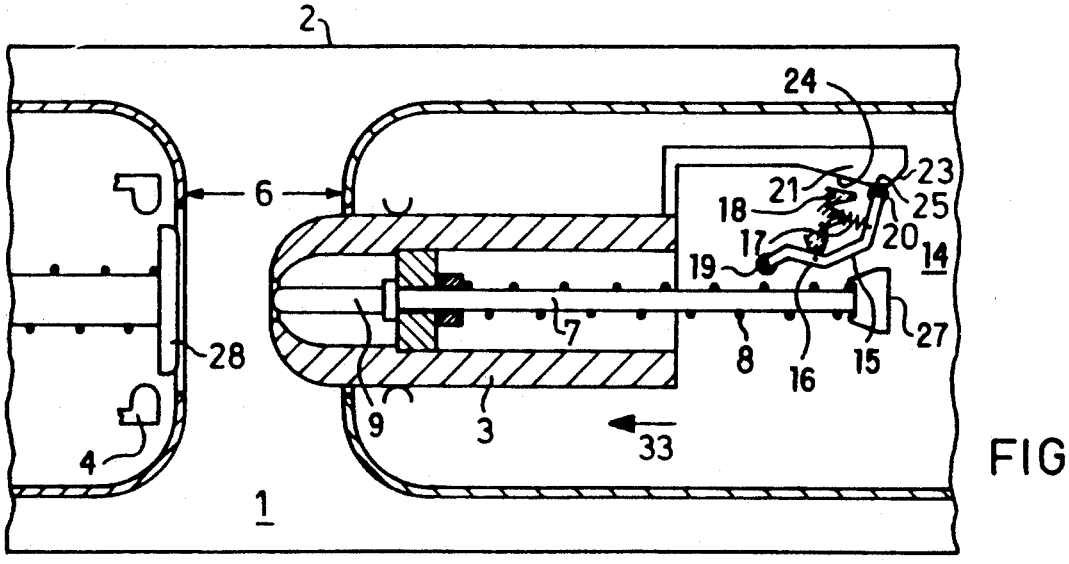
Figure 5:
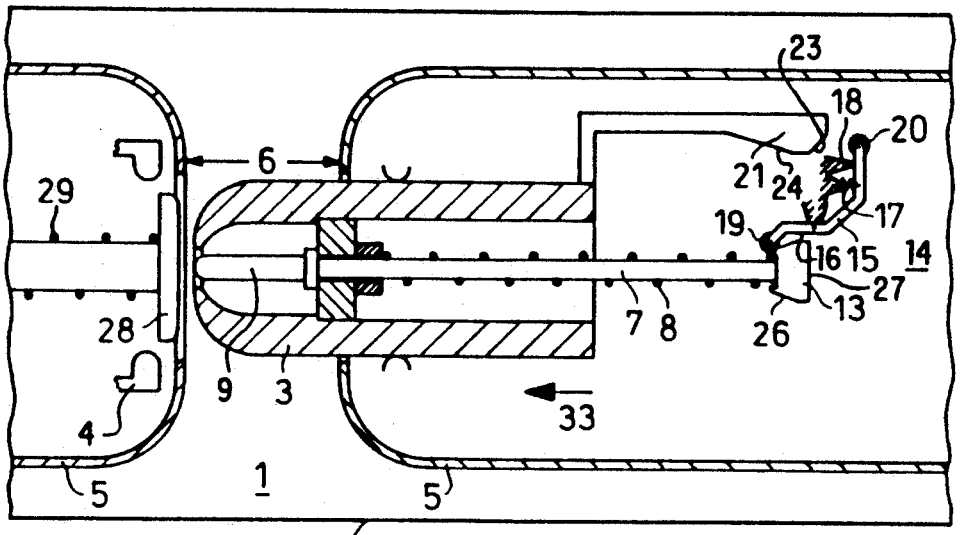

As the closing movement progresses further, the guide surface 21 deflects the angle lever 15 by means of the contact roller 20 until the contact roller 20 initially lies in the area 25 of the guide surface 21 (FIG. 4), and then after rolling off the stop face 23, loses contact with the guide surface 21, so that the angle lever 15 is again pressed against the limit stop 18 by the restoring spring 17 and consequently regains its neutral position (FIG. 5).

Figure 6:
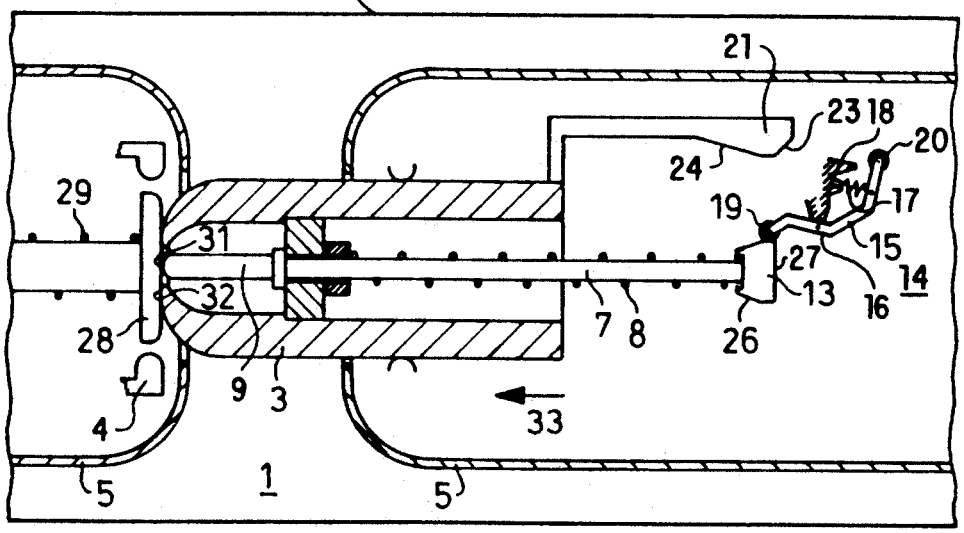
Figure 7:
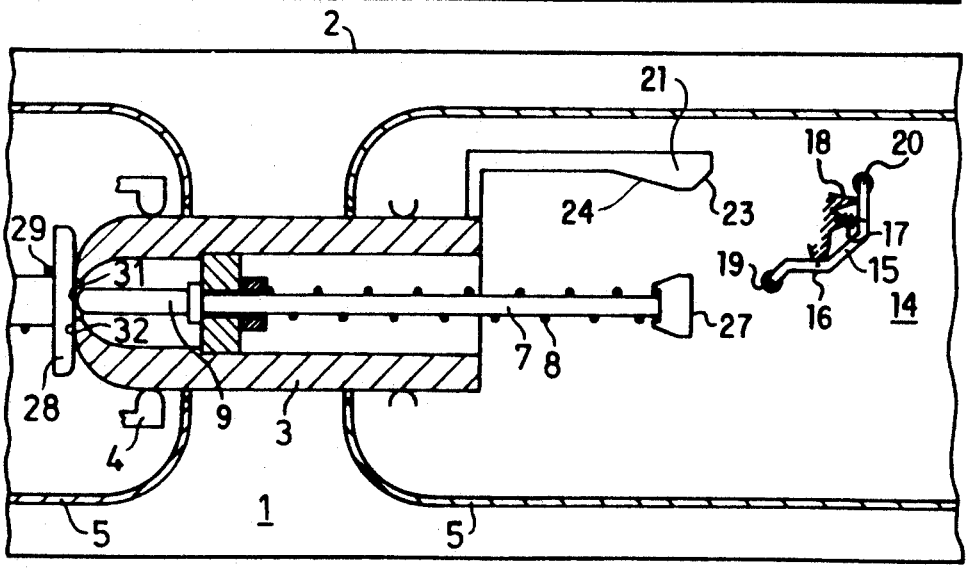

During its closing movement, the main contact pin 3 takes along the auxiliary contact pin 7. The blocking roller 19 comes to an abutment at the conical surface 26 of the adjusting screw 13, before the main contact pin 3 bridges the entire isolating distance 6. While the closing movement continues, the blocking roller 19 runs up the conical surface 26 and thus, in turn, deflects the two-armed angle lever 15 out of its neutral position (FIG. 6), so that the adjusting screw 13 can pass the angle lever 15 without any resistance. The main contact pin 3 abuts thereby on the shield electrode 28, which constitutes the mating contact for the auxiliary contact pin 7, and presses it out of its neutral position, whereby the compression spring 29 is loaded. Together with the auxiliary contact pin 7, the main contact pin 3 continues its closing movement until it reaches its closed position depicted in FIG. 7, in which the main contact pin 3 is in contact with the mating contact 4 and with its end face 32 presses the shield electrode 28 into its limit position inside the field plate 5, and thereby loads the compression spring 29. The end face 31 of the auxiliary contact pin 7 likewise abuts against the shield electrode 28. Thus, in this closed position, the isolating switch is closed, and the current is transmitted from the main contact pin 3 to the mating contact 4. Also, an equipotential bonding exists between the main contact pin 7 and its mating contact consisting of the shield electrode 28. In the closed position, the angle lever 15 of the mechanical control unit 14 is again situated in its neutral position.

Figure 8:
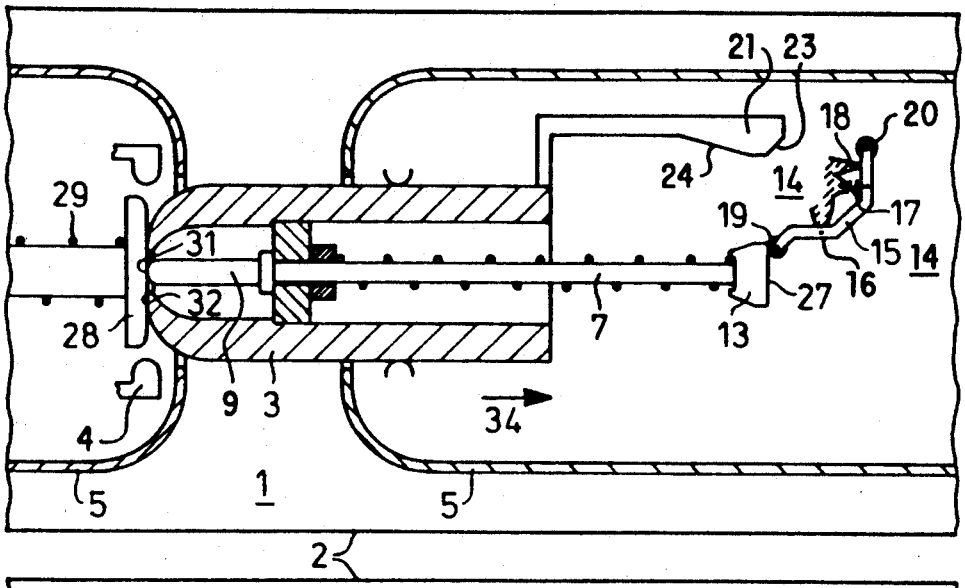
Figure 9:
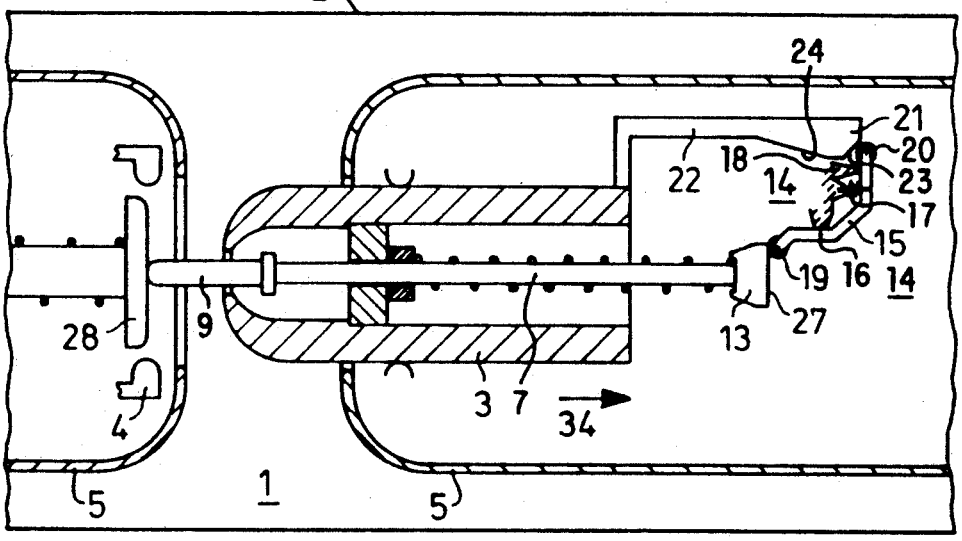

FIG. 8 shows the beginning of the opening movement of the main contact pin 3 characterized by the arrow 34. During this movement, the compression spring 29 is initially unloaded, so that the shield electrode 28 follows the main contact pin 3 somewhat and continues to abut its end face 32, whereby it presses the end face 31 of the auxiliary contact pin in front of it. However, when the end face 27 of the adjusting screw 13 comes into contact with the blocking roller 19 of the mechanical control unit 14 before the neutral position of the shield electrode 28 is reached, it locks automatically, because the angle lever 15 is pressed against the limit stop 18. In this manner, both the shield electrode 28 as well as the auxiliary contact pin 7 are prevented from moving further in the opening direction. However, the main contact pin 3 and, connected to it, the link 22 with the guide surface 21 continue to move to an opening position (FIG. 9). Consequently, the main contact pin 3 has already separated from the mating contact 4, while the equipotential bonding between the auxiliary contact pin 7 and the shield electrode 28 is still maintained.

Figure 10:
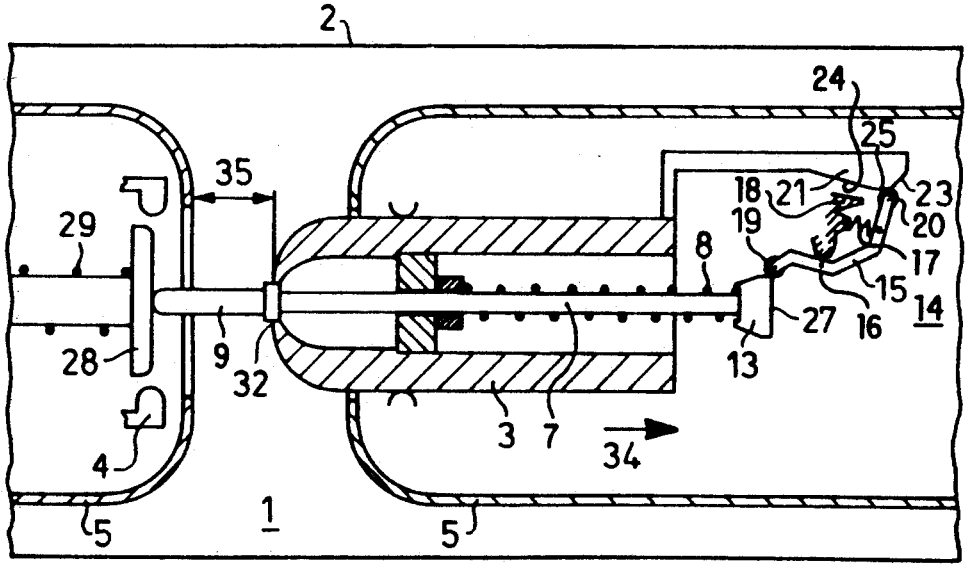

The position of the guide surface 21 and the sum of the lever arms of the angle lever 15 is dimensioned so that at a predetermined distance 35, depicted by arrows, between the field plate 5 of the mating contact 4 and the end face 32 of the main contact pin 3, the angle lever 15 has achieved its maximum deflection by means of the stop face 23 through the contact roller 20, so that the angle lever is pushed out of the neutral position and abuts the area 25. Simultaneously the blocking roller 19 is lifted over the end face 27 of the adjusting screw 13, so that the mechanical control unit 14 no longer retains the auxiliary contact pin 7 (FIG. 10). This signifies the triggering instant for the auxiliary contact pin 7, since the spring 8 can now unload. The distance 35 determining this triggering instant is selected based on the required dielectric strength between the field plate 5 and the main contact pin 3.

Figure 11:
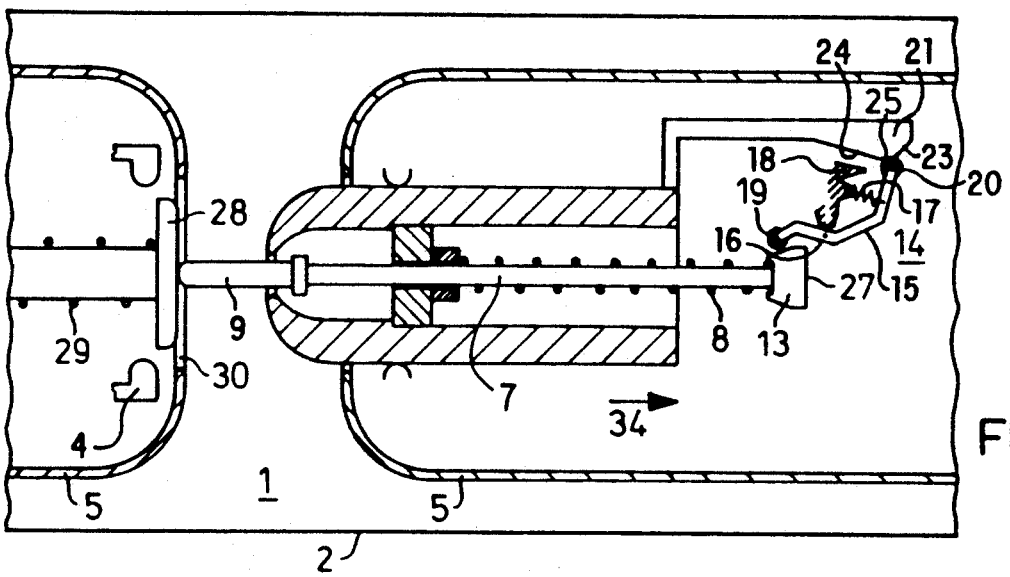
Figure 12:
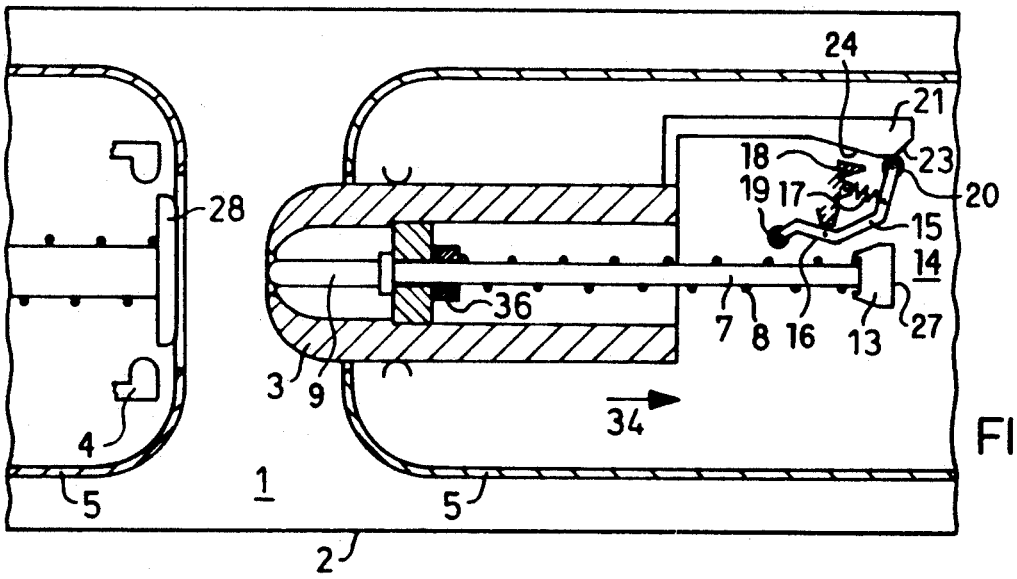

As a result of the unloading of the spring 8, the auxiliary contact pin 7 is retracted with a greater velocity into the inside of the main contact pin 3, which continues to move in the opening direction. Since, however, the compression spring 29 is selected to have such a spring tension that it exerts an acceleration on the shield electrode 28 greater than the acceleration exerted by the spring 8 on the auxiliary contact pin 7, the auxiliary contact pin 7 initially remains in contact with the shield electrode 28 until this electrode has reached its neutral position. The auxiliary contact pin 7 already accelerates thereby, so that at the moment of separation from the shield electrode 28, it already has a high velocity, which is then increased still further (FIG. 11). This improves the ability of the isolating switch 1 to extinguish an electric arc, such as those occuring in the switching of magnetizing currents in transformers. After the auxiliary contact pin 7 has reached its limit position in the main contact pin 3 (see FIG. 12), then both return together to the open position (FIGS. 1, 2).

Generally, a small magnetizing current can be conducted through the spring 8 of the auxiliary contact pin 7 and through the compression spring 29 of the shield electrode 28. At higher currents, providing a contact system for the shield electrode 28 and a contact system in the clamping ring 10 for the auxiliary contact pin 7 is advantageous. For this purpose, insulating the spring 8 on one side is necessary. This is achieved by configuring a bushing 36 made of insulating material between the clamping ring 10 and the spring 8. However, the bushing 36 is not necessary at lower currents.

As already explained, the sum of the lever arms of the two-armed angle lever 15 corresponds approximately to the distance 35 of the main contact pin 3 from the counter electrode 5 during the opening movement, when the auxiliary contact pin is released. This means that the end face 27 of the adjusting screw 13 must be situated exactly under the point of intersection between the stop face 23 and the parallel area 25 of the guide surface 21. If, on the other hand, the adjusting screw 13 is adjusted so that in the open position, a distance 37 indicated in FIG. 1 by arrows between the end face 27 and the point of intersection 23/25 appears, then this distance 37, which can be positive (in the opening direction) or negative (in the closing direction) must be considered accordingly. Consequently, the adjusting screw 13 influences the distance 37 in addition to adjusting the preloading of the spring 8.

Figure 13:
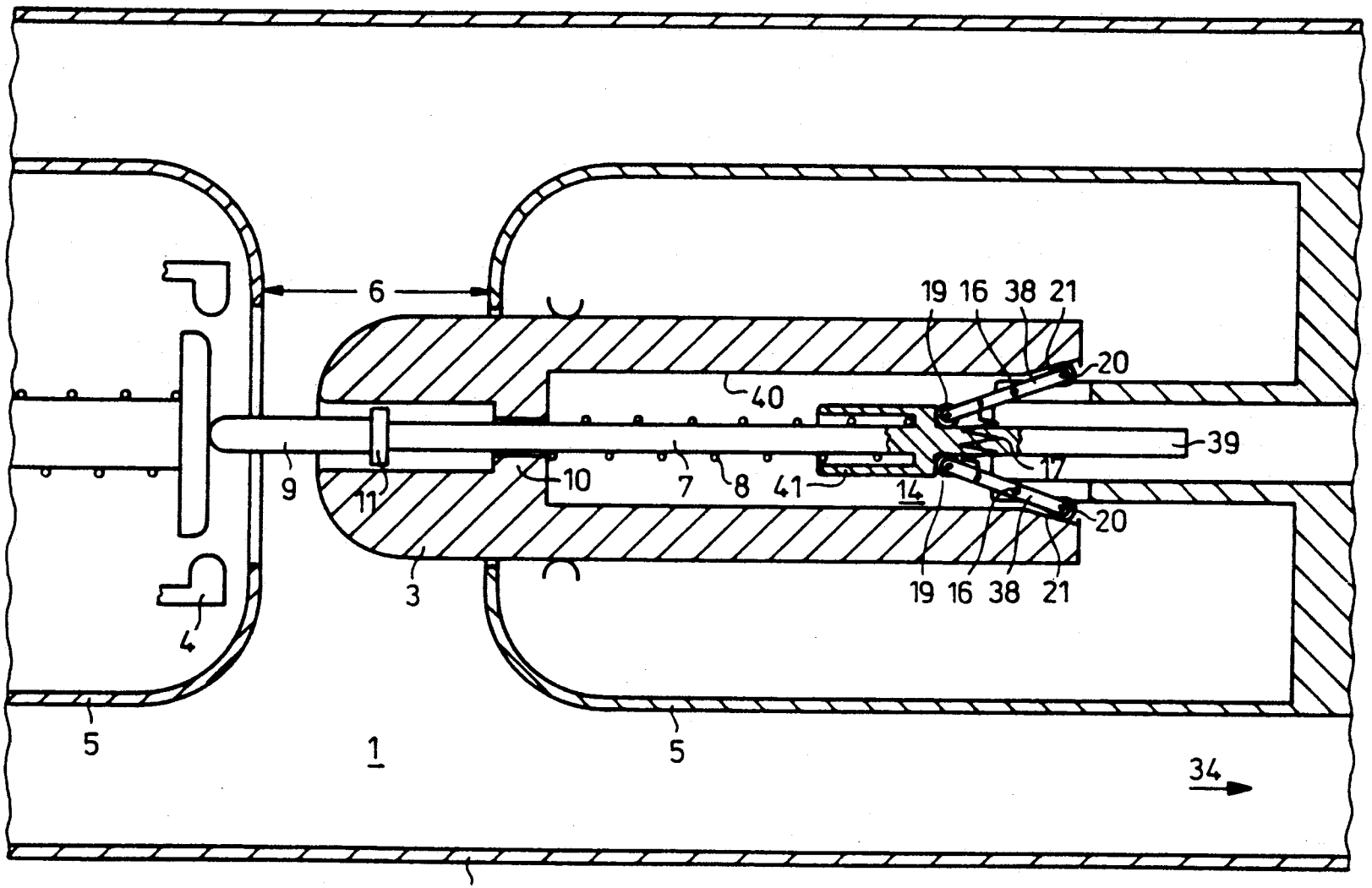
FIG. 13 depicts a second exemplified embodiment as a longitudinal section through the isolating switch, likewise in a larger scale corresponding to FIG. 1.

A second exemplified embodiment of the isolating switch 1 according to the present invention is depicted in FIG. 13. FIG. 13 shows the main contact pin 3 at the beginning of the opening movement 34 at an instant when the auxiliary contact pin 7 still abuts with its end face 31 on the shield electrode 28. This electrode is not yet situated in its neutral position, but rather is retained when the compression spring 29 is loaded by the auxiliary contact pin 7, because this auxiliary contact pin 7 is prevented from carrying out an opening movement 34 as a result of the blocking by means of the mechanical control unit 14.

The mechanical control unit 14 comprises two two-armed levers 38, which are arranged symmetrically to the longitudinal axis of the main contact pin 3 and each carry at the ends a contact roller 20 and a blocking roller 19 and are permanently fixed at the pivot point 16. The restoring spring 17 attempts to bring together the two ends of the lever 38 carrying the blocking roller 19. These ends abut in the neutral position on a limit stop formed by a centrical lug 39 of the auxiliary contact pin 7. Thus, the auxiliary contact pin is centered, in addition, by the mechanical control unit 14.

In this isolating switch 1, the guide surfaces 21 for deflecting the contact rollers 20 are configured directly on the main contact pin 3. They are tapered to run towards the inner bore hole 40 of the main contact pin 3 and dimensioned so that at the desired instant, based on the position of the main contact pin 3 in the isolating distance 6 during the opening movement, the blocking rollers 19 lift up from the limit stop and release the auxiliary contact pin 7. Since the blocking rollers 19 no longer abut on the centrical lug 39, which serves as a limit stop, a shield tube 41 is provided, which surrounds the spring 8 of the auxiliary contact pin 7. This shield tube 41 prevents the blocking rollers 19 from coming into contact with the turns of the spring 8. The length of the shield tube 41 is selected so that the spring 8 is protected in every position of the auxiliary contact pin 7.

What is claimed is:

1. An isolating switch for metal-clad, compressed-gas insulated high-voltage switchgears having an open position and a closed position, comprising:

a) two shielding field plates, said shielding field plates
 i) being separated by an isolating distance;

b) a main contact pin, said main contact pin disposed at least partially within a first one of said shielding field plates
 i) being tubular,
 ii) being movable
 iii) having a longitudinal axis, and
 iv) being able to bridge said isolating distance, c) a mating contact, said mating contact disposed within a second one of said shielding field plates
 i) having a hollow design, and
 ii) being fixed;

d) an auxiliary contact pin, said auxiliary contact pin
 i) being contained within said main contact pin,
 ii) being axially movable within said main contact pin,
 iii) having a limit stop at a first end, and
 iv) having a second end facing said isolating distance;

e) a clamping ring, said clamping ring
 i) being provided within said main contact pin, and
 ii) being penetrated by said auxiliary contact pin;

f) a first spring, said first spring
 i) surrounding said auxiliary contact pin, and
 ii) extending between the limit stop and the clamping ring;

g) a second mating contact, said second mating contact
 i) being situated in said mating contact;

h) a guide surface, said guide surface
 i) being connected to said main contact pin;

i) a mechanical control unit, said mechanical control unit
 i) being permanently mounted inside said first one of said shielding field plates, and
 ii) further comprising
  a lever arrangement, said lever arrangement being rotatably supported,
  locking automatically in the field plate allocated to the main contact pin when the isolating switch is in said closed position,
  permitting the closing movement of the auxiliary contact pin, and
  retaining the auxiliary contact pin at the beginning of the transition from said closed position of said isolating switch to said open position of said isolating switch until said lever arrangement is deflected by said guide surface;

wherein, in the open position, the auxiliary contact pin is situated inside the main contact pin, in the closed position, the auxiliary contact pin comes to abut said second mating contact, when the switch begins a transition from said closed position to said open position, the auxiliary contact pin remains abutted against said second mating contact until said auxiliary contact pin is returned to a neutral position where it is released by said mechanical control unit and reaches an velocity via first spring of greater magnitude than that of the main contact pin.

2. The isolating switch of claim 1 wherein said second mating contact comprises a spring loaded shield electrode having a neutral position and a closed position, wherein said second mating contact, in said neutral position is situated in an opening of said second one of the shielding field plates, and wherein said main contact pin contacts both said mating contact and said second mating contact in said closed position.

3. The isolating switch of claim 1 wherein said lever arrangement comprises a two armed angle lever.

4. The isolating switch of claim 2 wherein said lever arrangement comprises a two armed angle lever.

5. The isolating switch of claim 1 wherein said main contact pin includes an end face and wherein said lever arrangement defines a lever arm which corresponds approximately to the distance between said end face and the first one of the shielding field plates when the lever arrangement is maximally deflected by said guide surface.

6. The isolating switch of claim 2 wherein said main contact pin includes an end face and wherein said lever arrangement defines a lever arm which corresponds approximately to the distance between said end face and the first one of the shielding field plates when the lever arrangement is maximally deflected by said guide surface.

7. The isolating switch of claim 3 wherein said main contact pin includes an end face and wherein said lever arrangement defines a lever arm which corresponds approximately to the distance between said end face and the first one of the shielding field plates when the lever arrangement is maximally deflected by said guide surface.

8. The isolating switch of claim 4 wherein said main contact pin includes an end face and wherein said lever arrangement defines a lever arm which corresponds approximately to the distance between said end face and the first one of the shielding field plates contact when the lever arrangement is maximally deflected by said guide surface.

9. The isolating switch of claim 1 further comprising:

j) a restoring spring, said restoring spring having a first and a second end
 i) said first end being fixed and said second end being attached to said lever arm; and k) a limiting stop,
wherein said restoring spring biases said lever arm toward said limiting stop such that said lever arm is held against said limiting stop in said closed position.

10. The isolating switch of claim 2 further comprising:
j) a restoring spring, said restoring spring having a first and a second end
i) said first end being fixed and said second end being attached to said lever arm; and
k) a limiting stop,
wherein said restoring spring biases said lever arm toward said limiting stop such that said lever arm is held against said limiting stop in said closed position.

11. The isolating switch of claim 3 further comprising:
j) a restoring spring, said restoring spring having a first and a second end
i) said first end being fixed and said second end being attached to said lever arm; and
k) a limiting stop,
wherein said restoring spring biases said lever arm toward said limiting stop such that said lever arm is held against said limiting stop in said closed position.

12. The isolating switch of claim 4 further comprising:
j) a restoring spring, said restoring spring having a first and a second end
i) said first end being fixed and said second end being attached to said lever arm; and
k) a limiting stop,
wherein said restoring spring biases said lever arm toward said limiting stop such that said lever arm is held against said limiting stop in said closed position.

13. The isolating switch of claim 5 further comprising:
j) a restoring spring, said restoring spring having a first and a second end
i) said first end being fixed and said second end being attached to said lever arm; and
k) a limiting stop,
wherein said restoring spring biases said lever arm toward said limiting stop such that said lever arm is held against said limiting stop in said closed position.

14. The isolating switch of claim 6 further comprising:
j) a restoring spring, said restoring spring having a first and a second end
i) said first end being fixed and said second end being attached to said lever arm; and
k) a limiting stop,
wherein said restoring spring biases said lever arm toward said limiting stop such that said lever arm is held against said limiting stop in said closed position.

15. The isolating switch of claim 7 further comprising:
j) a restoring spring, said restoring spring having a first and a second end
i) said first end being fixed and said second end being attached to said lever arm; and
k) a limiting stop,
wherein said restoring spring biases said lever arm toward said limiting stop such that said lever arm is held against said limiting stop in said closed position.

16. The isolating switch of claim 8 further comprising:
j) a restoring spring, said restoring spring having a first and a second end
i) said first end being fixed and said second end being attached to said lever arm; and
k) a limiting stop,
wherein said restoring spring biases said lever arm toward said limiting stop such that said lever arm is held against said limiting stop in said closed position.

17. The isolating switch of claim 9 wherein said auxiliary contact pin further includes a central lug, and wherein said lever arrangement includes two levers, said two levers
i) are arranged symmetrically to said longitudinal axis of said main contact pin, and
ii) are connected by said restoring spring such that they are pressed against said central lug.

18. The isolating switch of claim 10 wherein said auxiliary contact pin further includes a central lug, and wherein said lever arrangement includes two levers, said two levers
i) are arranged symmetrically to said longitudinal axis of said main contact pin, and
ii) are connected by said restoring spring such that they are pressed against said central lug.

19. The isolating switch of claim 11 wherein said auxiliary contact pin further includes a central lug, and wherein said lever arrangement includes two levers, said two levers
i) are arranged symmetrically to said longitudinal axis of said main contact pin, and
ii) are connected by said restoring spring such that they are pressed against said central lug.

20. The isolating switch of claim 12 wherein said auxiliary contact pin further includes a central lug, and wherein said lever arrangement includes two levers, said two levers
i) are arranged symmetrically to said longitudinal axis of said main contact pin, and
ii) are connected by said restoring spring such that they are pressed against said central lug.

21. The isolating switch of claim 13 wherein said auxiliary contact pin further includes a central lug, and wherein said lever arrangement includes two levers, said two levers
i) are arranged symmetrically to said longitudinal axis of said main contact pin, and
ii) are connected by said restoring spring such that they are pressed against said central lug.

22. The isolating switch of claim 14 wherein said auxiliary contact pin further includes a central lug, and wherein said lever arrangement includes two levers, said two levers
i) are arranged symmetrically to said longitudinal axis of said main contact pin, and
ii) are connected by said restoring spring such that they are pressed against said central lug.

23. The isolating switch of claim 15 wherein said auxiliary contact pin further includes a central lug, and wherein said lever arrangement includes two levers, said two levers
i) are arranged symmetrically to said longitudinal axis of said main contact pin, and
ii) are connected by said restoring spring such that they are pressed against said central lug.

24. The isolating switch of claim 16 wherein said auxiliary contact pin further includes a central lug, and wherein said lever arrangement includes two levers, said two levers
i) are arranged symmetrically to said longitudinal axis of said main contact pin, and ii) are connected by said restoring spring such that they are pressed against said central lug.

25. The isolating switch of claim 1 wherein said guide surface, i) is designed as a cam, and ii) has an area parallel to said longitudinal axis of said main contact pin.

26. The isolating switch of claim 1 wherein said lever arrangement includes two ends, each of which is provided with a roller.

27. The isolating switch in any one of claims 1–6 further comprising a conical adjusting screw said conical adjusting screw i) forming said limiting stop, and ii) enabling adjustments to the coefficient of said first spring.

* * * * *